US010712059B2

(12) United States Patent
Roman

(10) Patent No.: US 10,712,059 B2
(45) Date of Patent: Jul. 14, 2020

(54) DISTRIBUTOR ASSEMBLY FOR SPACE CONDITIONING SYSTEMS

(71) Applicant: Allied Air Enterprises LLC, West Columbia, SC (US)

(72) Inventor: Hany Roman, Aiken, SC (US)

(73) Assignee: Allied Air Enterprises LLC, West Columbia, SC (US)

( * ) Notice: Subject to any disclaimer, the term of this patent is extended or adjusted under 35 U.S.C. 154(b) by 257 days.

(21) Appl. No.: 15/136,527

(22) Filed: Apr. 22, 2016

(65) Prior Publication Data

US 2016/0238289 A1 Aug. 18, 2016

Related U.S. Application Data

(62) Division of application No. 13/602,997, filed on Sep. 4, 2012, now Pat. No. 9,335,076.

(51) Int. Cl.
*F25B 39/00* (2006.01)
*F25B 1/00* (2006.01)
(Continued)

(52) U.S. Cl.
CPC ..... *F25B 39/00* (2013.01); *F25B 1/00* (2013.01); *F25B 13/00* (2013.01); *F25B 39/028* (2013.01);
(Continued)

(58) Field of Classification Search
CPC ..... F16K 15/02; F16K 15/021; F16L 39/00; F16L 39/04; F16L 39/06; F25B 39/02;
(Continued)

(56) References Cited

U.S. PATENT DOCUMENTS 3,457,949 A * 7/1969 Coulter ..... F16K 15/026 137/543.21
4,524,823 A 6/1985 Hummel et al.
(Continued)

OTHER PUBLICATIONS

Blevins, R.D., Applied Fluid Dynamics Handbook, 1984, New York, Van Nostrand Reinhold Co., pp. 141-162.

*Primary Examiner* — Frantz F Jules
*Assistant Examiner* — Erik Mendoza-Wilkenfel
(74) *Attorney, Agent, or Firm* — Winstead PC

(57) ABSTRACT

A distributor assembly for a space conditioning system comprising a sealed expansion device and a sealed distributor housing. The expansion device has a first opening, a second opening and an interior chamber there-between. The interior chamber contains an orifice housing, wherein the orifice housing has a through-hole orifice therein. The orifice housing is configured to move between the first opening and the second opening within the interior chamber. An outer surface of the orifice housing forms a fluid stop around the first opening such that a refrigeration fluid of the space conditioning system delivered through the second opening can substantially only pass through the through-hole orifice to the first opening. The distributor housing has a largest opening that is permanently sealed to the first opening of the sealed expansion device and a plurality of smaller openings configured to be fluidly connected to a heat-exchange coil of the space conditioning system.

12 Claims, 7 Drawing Sheets

(51) Int. Cl.
*F25B 13/00* (2006.01)
*F25B 39/02* (2006.01)
*F25B 41/06* (2006.01)
*F25B 39/04* (2006.01)

(52) U.S. Cl.
CPC ..... *F25B 41/062* (2013.01); *F25B 39/04* (2013.01); *F25B 2313/02741* (2013.01); *Y10T 29/4935* (2015.01)

(58) Field of Classification Search
CPC .. F25B 39/028; F25B 2500/01; F25B 41/043; F25B 41/06; F25B 41/062
See application file for complete search history.

(56) References Cited

U.S. PATENT DOCUMENTS 4,531,624 A * 7/1985 Ideta ..... B60T 11/326 137/513.3
4,784,177 A * 11/1988 Sepso ..... F25B 41/06 137/513.3
4,896,696 A * 1/1990 Bradley ..... F16L 55/027 137/513.3
5,041,257 A * 8/1991 Sepso ..... F25B 41/06 137/513.3
5,265,438 A * 11/1993 Knowles ..... F25B 41/06 137/513.3
5,341,656 A 8/1994 Rust, Jr. et al.
5,564,754 A * 10/1996 Grenga ..... F16L 19/02 285/125.1
5,893,273 A * 4/1999 Casiraghi ..... F25B 41/06 138/44
5,894,741 A * 4/1999 Durham ..... F25B 41/06 137/493.8
5,937,670 A * 8/1999 Derryberry ..... F25B 13/00 62/174
6,158,466 A 12/2000 Riefler
8,931,509 B2 * 1/2015 Beard ..... F25B 39/028 137/561 A
2004/0035134 A1 * 2/2004 Oberley ..... F25B 39/028 62/324.6
2005/0028553 A1 * 2/2005 Grau ..... F25B 43/00 62/528
2010/0326640 A1 * 12/2010 Higashiyama ..... B21D 53/06 165/154
2012/0145246 A1 * 6/2012 French ..... F25B 39/028 137/1

* cited by examiner

DISTRIBUTOR ASSEMBLY FOR SPACE CONDITIONING SYSTEMS

CROSS REFERENCE TO RELATED INFORMATION

This application claims priority to U.S. patent application Ser. No. 13/602,997, filed Sep. 4, 2012, titled Distributor Assembly for Space Conditioning Systems, now U.S. Pat. No. 9,335,076 the contents of which are hereby incorporated herein in its entirety.

TECHNICAL FIELD

This application is directed, in general, to space conditioning systems, and in particular, to assemblies and methods for distributing refrigerant to evaporator coils of the system.

BACKGROUND OF THE INVENTION

It is desirable for a refrigeration fluid being delivered from an expansion device to an evaporator coil of a space conditioning system to have a tightly controlled uniform pressure drop throughout the evaporator coil's circuit. For instance, if the pressure drop is not uniform, then the distribution of refrigeration fluid is not the same throughout the coil, and this, in turn, reduces the heat transfer efficiency of the coil. To facilitate a uniform flow distribution of the refrigeration fluid to the evaporator coil, a distributor unit is connected to the output of the expansion device and to different parts of the evaporator coil.

Additionally, space conditioning systems are often designed to accommodate different sizes of evaporator coils, in which case, it is necessary to change the expansion device so as to maintain the desired specific uniform pressure drop. As such, the distributor and expansion device are designed to be detachably coupled together. Typically, the expansion device itself can be reversibly disconnected from the distributor (e.g., through threaded connections) so that an orifice housing in the expansion device can be substituted with a differently-sized orifice housing and then the expansion device and distributor reconnected.

BRIEF SUMMARY OF THE INVENTION

One embodiment of the disclosure is distributor assembly for a space conditioning system. The assembly comprises a sealed expansion device and a sealed distributor housing. The expansion device has a first opening, a second opening and an interior chamber there-between. The interior chamber contains an orifice housing, wherein the orifice housing has a through-hole orifice therein. The orifice housing is configured to move between the first opening and the second opening within the interior chamber. An outer surface of the orifice housing forms a fluid stop around the first opening such that a refrigeration fluid of the space conditioning system delivered through the second opening can substantially only pass through the through-hole orifice to the first opening. The distributor housing has a largest opening that is permanently sealed to the first opening of the sealed expansion device and a plurality of smaller openings configured to be fluidly connected to a heat-exchange coil of the space conditioning system.

Another embodiment of the disclosure is a space conditioning system. The system comprises a first heat-exchange coil, a second heat-exchange coil and a compressor configured to compress a refrigeration fluid and to transfer the refrigeration fluid to a discharge line and to receive the refrigeration fluid from a suction line, wherein the discharge line is connected to one of the first heat-exchange coil or the second heat-exchange coil, and the suction line is connected to the other of the first heat-exchange coil or the second heat-exchange coil. The system further comprises the above-described distributor assembly. The plurality of smaller openings are configured to be fluidly connected to one of the first heat-exchange coil or the second heat-exchange coil. The distributor assembly also comprises a plurality of delivery tubes, wherein one end of each of the delivery tubes is sealed to one of the smaller openings of the distributor housing, and, another end of each of the delivery tubes are each fluidly connected to different access ports of the one first heat-exchange coil or second heat-exchange coil.

Still another embodiment of the disclosure is a method of manufacturing the distributor assembly for a space conditioning system. The method comprises providing the above-described sealed expansion device and sealed distributor housing, and permanently sealing the first opening of the sealed expansion device to the largest opening of the sealed distributor housing.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1A:
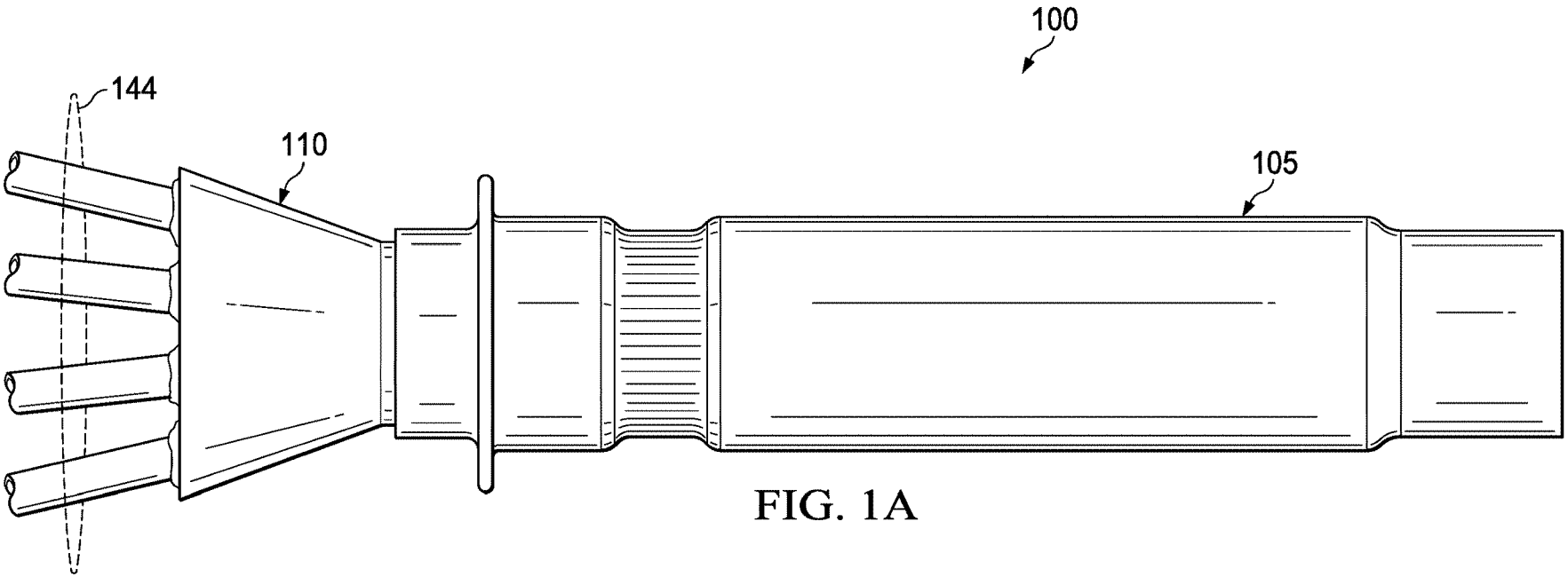
FIG. 1A presents a perspective view of an example distributor assembly of the disclosure.

The term, "or," as used herein, refers to a non-exclusive or, unless otherwise indicated. Also, the various embodiments described herein are not necessarily mutually exclusive, as some embodiments can be combined with one or more other embodiments to form new embodiments.

As part of the present disclosure, it was recognized that for space conditioning systems with a fixed evaporator coil, it is not necessary to use an expansion device and distributor which are designed to be detached from each other, or, an expansion device configured to have an orifice housing that can be substituted with a different orifice housing.

In contrast to existing combinations of re-connectable distributors and expansion device, the disclosed distributor assembly comprises a sealed expansion device and sealed distributor housing which are permanently sealed together. The permanently sealed distributor housing of the disclosure provides substantial cost savings over previous designs because of reduced costs as compared to providing an internally accessible expansion device that is detachably connected to a distributor.

For instance, there is no need to provide an expansion device and distributor having complimentary threaded portions to allow detachable connection to each other. Rather, a low-cost sealed expansion devices, with an orifice housing with a set through-hole orifice, and low-cost sealed distributor assembly can be used. Additionally, because the distributor assembly is a permanently sealed combination of a sealed expansion device and sealed distributor housing, installing the distributor assembly in the space conditioning system is substantially simplified, and, the entire distributor assembly can be placed in an inaccessible location within an installed space conditioning system. Moreover, the potential for refrigerant fluid leakage through a loosened connection interface between the expansion device and the distributor is eliminated by using a permanently sealed assembly.

The term sealed, as used herein, is defined as a component or an assembly whose internal features cannot be accessed without cutting into, or unbrazing, the sealed component part or sealed assembly of parts. Notwithstanding the above, the sealed expansion device and sealed distributor housing have openings to permit refrigeration fluid to flow into and out of these structures, but such opening do not provide adequate access e.g., for the purposes of accessing replacing the orifice housing or for replacing one size of the expansion device with differently-sized of expansion device. For instance, an orifice housing that is inside of a sealed expansion device cannot be accessed without cutting into the expansion device. For instance, the distributor assembly comprising a sealed expansion device and sealed distributor housing which, in turn, are permanently sealed together, cannot be separated without cutting into, or unbrazing, one or both of the expansion device or distributor housing, or a sealed connection there-between.

One embodiment of the present disclosure is a distributor assembly for a space conditioning system. FIG. 1A presents a perspective view of an example distributor assembly 100 of the disclosure, and FIG. 1B presents a exploded cut-way plan view of the example distributor assembly depicted in FIG. 1A.

As illustrated in FIG. 1A, the distributor assembly 100 comprises a sealed expansion device 105 and a sealed distributor housing 110 which, in turn, are sealed together.

Figure 1B:
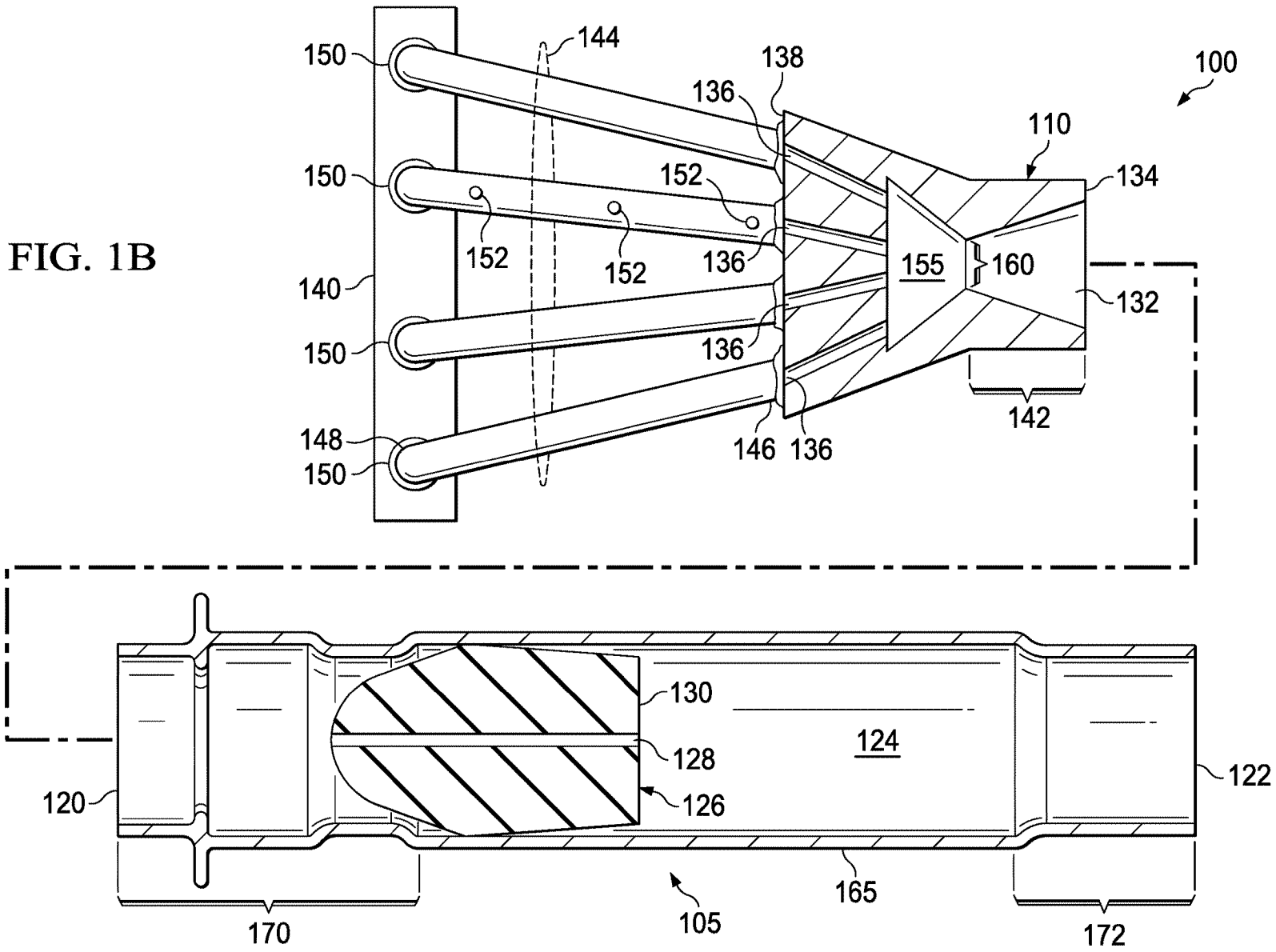
FIG. 1B presents an exploded cut-way plan view of the example distributor assembly depicted in FIG. 1A.

As further illustrated in FIG. 1B, the sealed expansion device 105 has a first opening 120, a second opening 122 and an interior chamber 124 there-between. The interior chamber 124 contains an orifice housing 126, wherein the orifice housing 126 has a through-hole orifice 128 therein. The orifice housing 126 is configured to move between the first opening 120 and the second opening 122 within the interior chamber 124. The outer surface 130 of the orifice housing 126 are configured to form a fluid stop (e.g., an annular seal around the first opening 120 such that a refrigerant fluid of the space conditioning system delivered through the second opening 122 can substantially only pass through the through-hole orifice 128 to the first opening 120.

Conversely, in some embodiments, when refrigeration fluid is delivered through the first opening 120 the fluid can flow around the outer surface 130 of the orifice housing 126 to the second opening 122. That is, the orifice housing 126 is configured to not form the fluid stop (e.g., no annular seal) when the refrigeration fluid is delivered through the opening towards the second opening and the refrigeration fluid can thereby pass substantially around the outer surface 130 of the orifice housing 126 to the second opening 122. In such configuration if the sealed expansion device 105 can be considered to further include check valve functionality when the refrigeration fluid flow is reversed such as described above. However in other embodiments the space conditioning system can further include a separate check valve.

The sealed distributor housing 110 has a largest opening 132 (e.g., in some cases on one end 134 of the housing 110) that is permanently sealed to the first opening 120 of the sealed expansion device 105, and, further includes a plurality of smaller openings 136 (e.g., in some cases, all located on an opposite end 138 of the housing 110) that are configured to be fluidly connected to a heat-exchange coil 140 of the space conditioning system.

As illustrated in FIG. 1B, in some embodiments, a tube portion 142 defining the largest opening 132 of the sealed distributor housing 110 is configured to fit inside of the first opening 120 of the sealed expansion device 105, e.g., to facilitate forming the permanent seal (e.g., a crimp seal and/or a brazed seal) between the expansion device 105 and distributor housing 110. In other cases the largest opening 132 of the sealed distributor housing 110 is configured to fit outside of the first opening 120 of the sealed expansion device 105, e.g., to facilitate forming the permanent seal.

In some embodiments, the distributor assembly 100, includes a plurality delivery tubes 144 (e.g., copper tubes), wherein one end 146 of each of the delivery tubes 142 is sealed (e.g., brazed seals) to one of the smaller openings of the distributor housing, and, another end 148 of each of the delivery tubes 144 are each fluidly connected to different access ports 150 of the heat-exchange coil 140 (e.g., to distribute fluid to different fluid-circulation circuits of the coil 140).

As further illustrated in FIG. 1B, in some embodiments, the orifice housing 126 of the expansion device 105 is configured as a cone-shaped piston head, e.g., a cylindrically-shaped structure which narrows along the direction of the through-hole 128 towards the first opening 120.

In some cases, the distributor housing 110 is configured to provide substantially equal flows of refrigerant to all of the delivery tubes 144. Providing substantially equal flow distributions to the delivery tubes 144, facilitates having a substantially uniform flow of refrigeration fluid throughout the heat exchange coil 140. Having a substantially uniform flow of refrigeration fluid throughout the heat exchange coil 140, in turn promotes efficient heat transfer from the coil 140 to conditioned air blowing over the coil 140. That is, a uniform distribution of the refrigeration fluid throughout the coil 140 causes the temperature of coil to be uniform. Therefore, the air blowing over different parts of the coil experience the same temperature. In contrast, if the flow distribution of refrigeration fluid to different circuits in the coil 140 differs, then some circuits will have high pressure than other circuits, which in turn, causes heat transfer to be less efficient.

In some cases, to help verify that the distributor housing 110 is providing substantially equal flows of refrigerant to all of the delivery tubes 144, the surface temperatures of the delivery tubes 144 can be monitored. After passing through the expansion device 105 the refrigeration fluid undergoes a temperature or drop (e.g., about 20° F. in some cases), and, if the distribution is uniform provided to all of the delivery tubes 144, then the surface temperature of each delivery tube 144 will decrease by substantially the same amount. For instance in some embodiments, when the refrigeration fluid is flowing through the through-hole orifice 128 of the sealed expansion device 105, towards the distributor housing, 110 a surface temperature decrease of each of the delivery tubes 144 are all equal to each other within about 4° F., and in some cases within about 2° F., and in still other cases within about 1° F. For instance, thermocouples 152 can be attached to same locations of each of the delivery tubes 144 (e.g., at the end closest to the distributor housing 110, at the end closest to the heat exchange coil 140, mid-way along the length of the delivery tube 144, or all of the above). The temperature from these thermocouples 152 can be recorded and compared during a cooling cycle of the system. Similar temperature measurements can be performed using thermocouples attached to different locations on the coil 140, with the expectation of similar target uniform of temperatures (e.g., within about 4° F.), if the distributor housing 110 is properly providing substantially equal flows of refrigerant to all of the delivery tubes 144 and onwards to the coil 140.

As further illustrated in FIG. 1B, in some embodiments, an internal chamber 155 of the sealed distributor housing 110 narrows to a smallest volume 160 before increasing again towards the end 138 of the housing 110 holding the plurality of openings 136. It is believed that such a chamber design promotes via the Venturi effect, velocity pressure distribution, where the refrigerant turbulates around the smallest volume 160 and then uniformly distributes to each of the delivery tubes 144.

In other embodiments, however, the internal chamber 155 could be formed into other shapes such as a spherical, hemi-spherically or cylindrically-shaped chamber. For embodiments of the chamber 155, the distribution of refrigerant is controlled by static pressure distribution within the chamber. Based on the present disclosure one skilled in the art would appreciate that the internal chamber 155 could be formed to have other shapes.

Figure 1C:
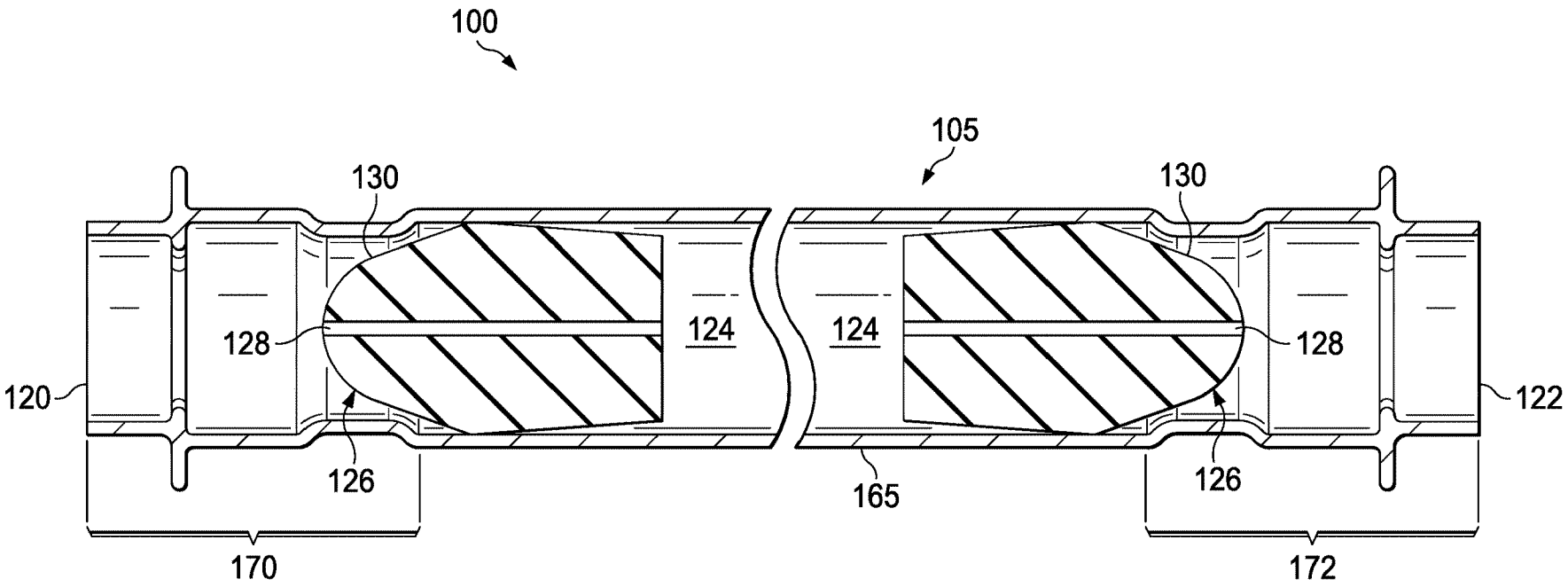
FIG. 1C presents a cut-way plan view of an alternative embodiment of the expansion device of the example distributor assembly depicted in FIGS. 1A and 1BA.

FIG. 1C presents a cut-way plan view of an alternative embodiment of the expansion device 105 of the example distributor assembly depicted in FIGS. 1A and 1BA. Such embodiments of the expansion device 105 may be used in certain heat-pump system applications of the distributor assembly 100. As illustrated the expansion device 105 can include two of the orifice housings 126. For example, the orifice housings 126 can both be configured as a cone-shaped piston head, e.g., a cylindrically-shaped structure which narrows along the direction of the through-hole 128 towards the first opening 120 and the second opening 122, respectively. Similar to that described above, the outer surface 130 of the orifice housing 126 are configured to form a fluid stop (e.g., an annular seal around the first opening 120 such that a refrigerant fluid of the space conditioning system delivered through the first opening 120 can substantially only pass through the through-hole orifice 128 to the second opening 122. In such embodiments, the assembly 100 can further include a second sealed distributor housing 110 that is sealed to the second opening 122, e.g., to facilitate coupling to a second heat-exchange coil.

Another embodiment of the disclosure is a space conditioning system. The space conditioning system can be configured for residential or commercial HVAC, or other space conditioning systems well known to those skilled in the art.

Figure 2A:
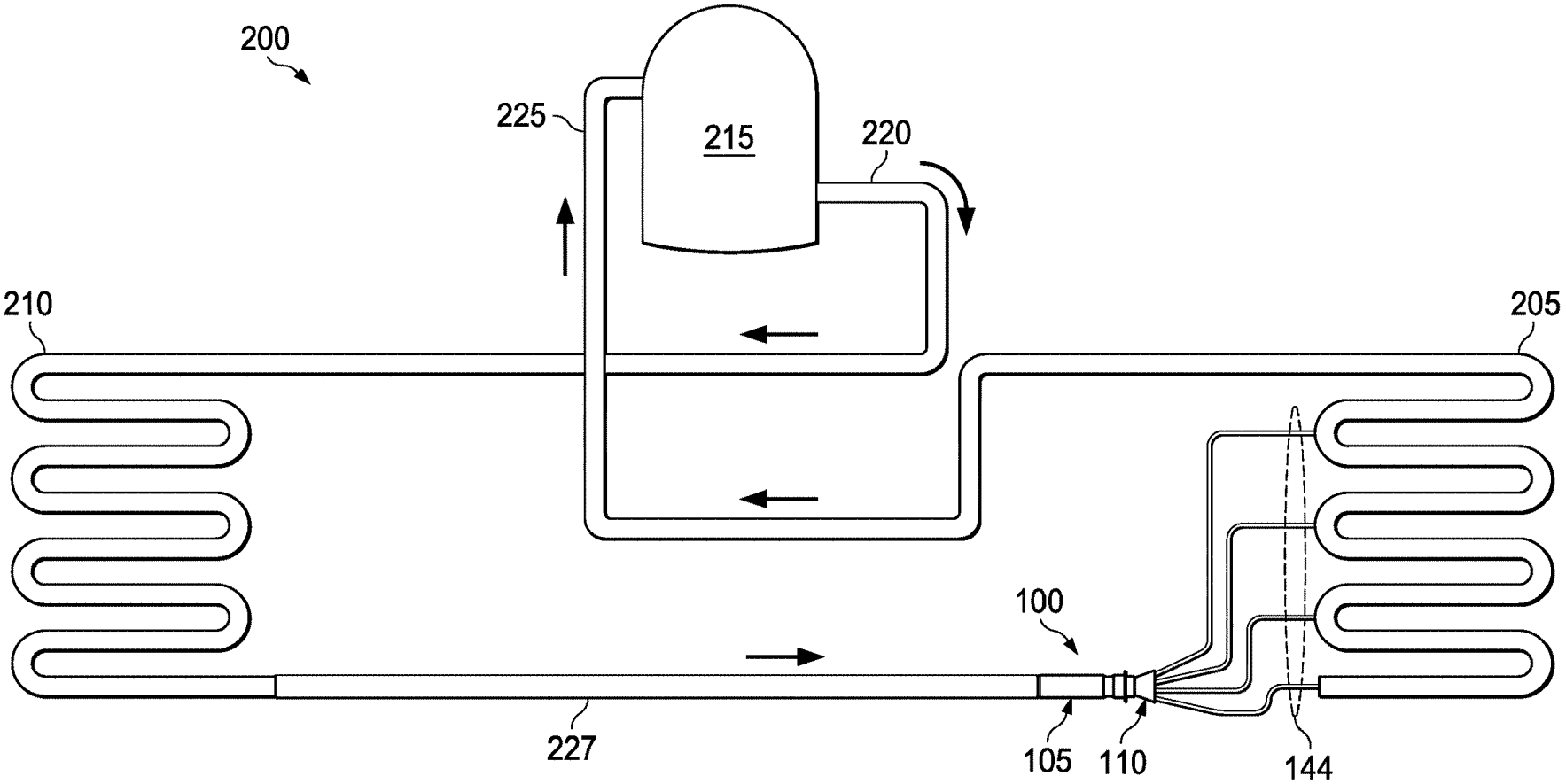
FIG. 2A presents an example layout diagram of an example space conditioning system of the disclosure, here configured as an air conditioning system, and which includes the distributor assembly of the disclosure, such as any of the embodiments of the distributor assembly discussed in the context of FIGS. 1A and 1B.
Figure 2B:
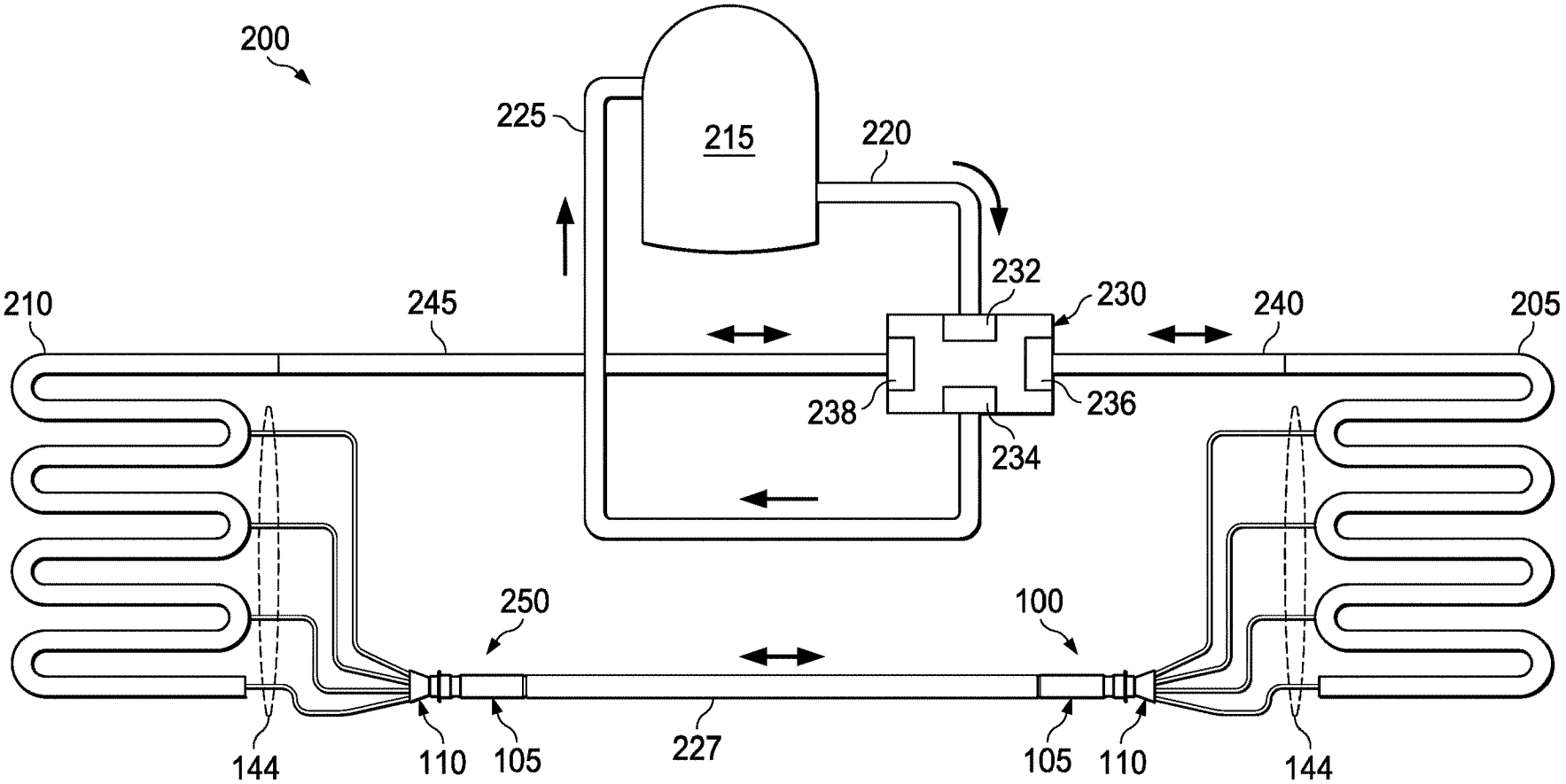
FIG. 2B presents an example layout diagram of an example space conditioning system of the disclosure, here configured as a heat pump system, and which includes the distributor assembly of the disclosure, such as any of the embodiments of the distributor assembly discussed in the context of FIGS. 1A and 1B.
Figure 2C:
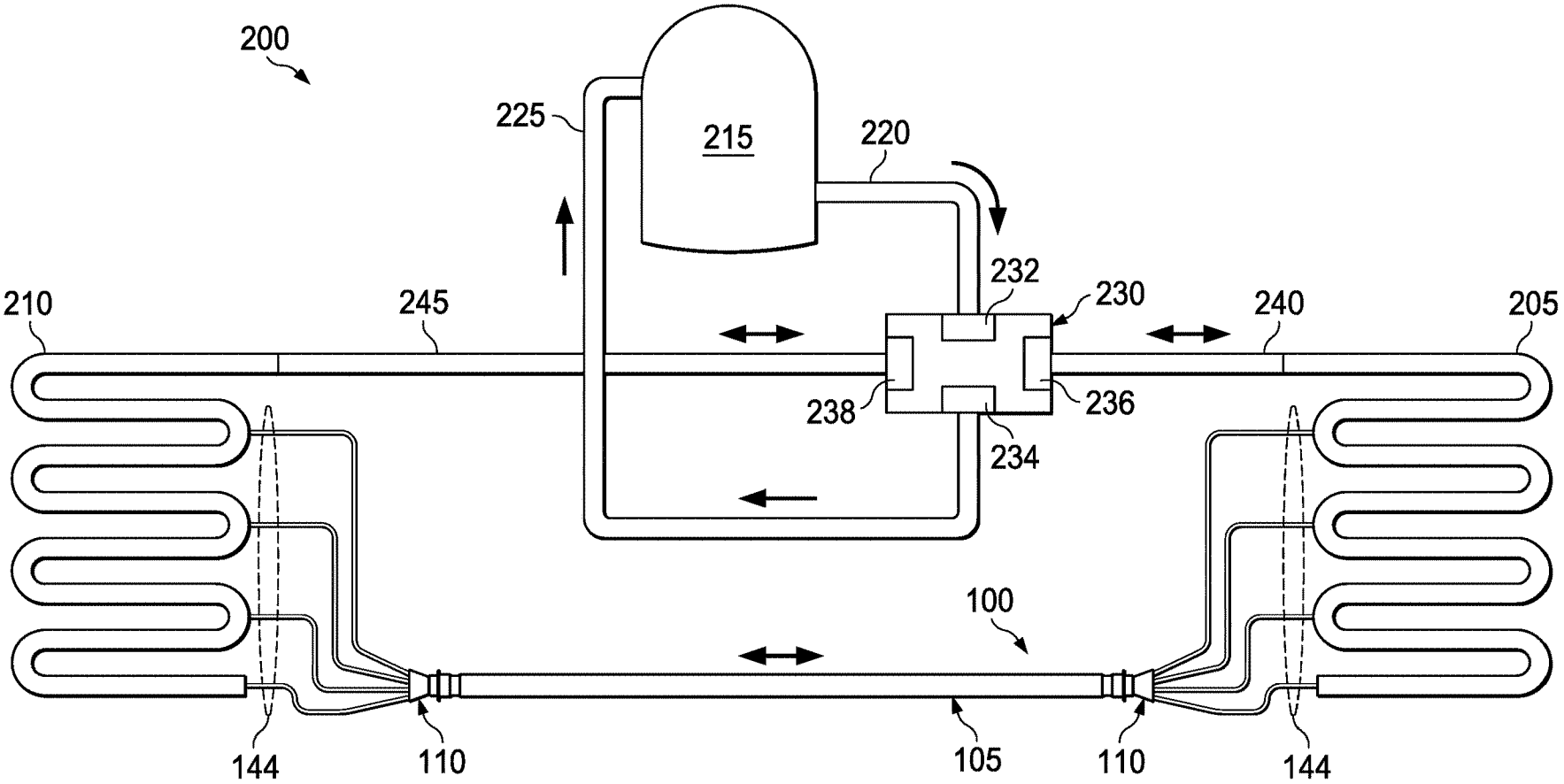
FIG. 2C presents an example layout diagram of an example space conditioning system of the disclosure, here configured as a heat pump system, and which includes the distributor assembly of the disclosure, such as any of the embodiments of the distributor assembly discussed in the context of FIGS. 1A and 1B.

FIG. 2A presents an example layout diagram of an example space conditioning system 200 of the disclosure here configured as an air conditioning system, and which includes the distributor assembly of the disclosure, such as any of the embodiments of the distributor assembly 100 discussed in the context of FIGS. 1A and 1B. FIGS. 2B and 2C present example layout diagrams of an example space conditioning system 200 of the disclosure, here configured as a heat pump system, and which includes the distributor assembly of the disclosure, such as any of the embodiments of the distributor assembly 100 discussed in the context of FIGS. 1A-1C.

The space conditioning system, such as either of the example systems 200 depicted in FIGS. 2A-2C comprise a first heat-exchange coil 205, a second heat-exchange coil 210 and a compressor 215. The compressor 215 is configured to compress a refrigeration fluid and to transfer the refrigeration fluid to a discharge line 220 and to receive the refrigeration fluid from a suction line 225 (e.g., lines made of copper tubing). The discharge line 220 is connected to one of the first heat-exchange coil 205 or the second heat-exchange coil 210, and, the suction line 225 is connected to the other of the first heat-exchange coil 205 or the second heat-exchange coil 210. As illustrated, in some embodiments, the first heat-exchange coil 205 and a second heat-exchange coil 210 are fluidly connected via a connection line 227.

The system 200 further includes a distributor assembly 100, including any of the embodiments of the assembly 100 such as discussed in the context of FIGS. 1A-1C above. For instance, the distributor assembly 100 of system 200 further includes the plurality of delivery tubes 144. One end 146 of each of the delivery tubes 144 is sealed to one of the smaller openings 136 of the distributor housing 110, and, another end of each of the delivery tubes 144 are each fluidly connected to different access ports 150 of one of the first heat-exchange coil 205 or the second heat-exchange coil 210 of the system 200.

In some cases, such as when the system 200 is configured as an air-conditioning system, as illustrated in FIG. 2A, the first heat-exchange coil 205 is configured as an evaporator coil, and, the delivery tubes 144 are each fluidly connected to the different access ports 150 of first heat-exchange coil 205. Further, the first opening 120 of the sealed expansion device 105 is configured to receive the refrigeration fluid transferred though the discharge line 220. In some such embodiments, the second heat exchange coil 210 is configured as a condenser coil, and configured to receive the refrigeration fluid from the first heat exchange coil 205 and to transfer the refrigeration fluid to the suction line 225.

The compressor 215 compresses the refrigeration fluid thereby causing the fluids pressure and temperature to increase. The refrigerant then flows through the discharge line 220 to the condenser coil 210 to dissipate heat, and then flows through the expansion device 105. As the refrigerant fluid flows through the expansion device (specifically the through-hole orifice 128), the refrigerant fluid changes from a higher pressure (prior to the expansion device) to a lower pressure (after exiting the expansion device), thereby causing the fluid to change phase and have decreased temperature. The refrigeration fluid then flows through the distributor housing 110 and the plurality of delivery tubes 144 to the evaporator coil 205. The evaporator coil 205, in turn, absorbs heat from air blowing over the coil 205 to thereby provide cooling to a space being cooled by the system 200. After passing through the evaporator coil 205 the refrigeration fluid returns to compressor 215 via a suction line 225.

In cases where the system 200 is configured as an air-conditioning system, the configurations of the heat exchange coils 205, 210 can be fixed. That is, one coil (e.g., coil 205) is always configured as the evaporator coil and the other coil (e.g., coil 210) is always configured as the condenser coil. For such a system 200, it is therefore sufficient to have a single distributor assembly 100 coupled to the heat exchange coil (e.g., coil 205) that is configured as the evaporator coil.

In some cases, such as when the system 200 is configured as a heat-pump system, such as illustrated in FIG. 2B, the first heat-exchange coil 205 is configured as an outdoor coil, and the second heat exchange coil 210 is configured as an indoor coil. For such a system 200 the configurations of the heat exchange coils 205, 210 can be switched, depending upon whether the system 200 is in a heating cycle or cooling cycle. That is, the coils 205, 210 can be considered to have alternative dual functionalities. For instance, the system 200 is in a cooling cycle mode, the indoor heat exchange coil (e.g., coil 210) can be configured as the evaporator coil and an outdoor heat exchange coil (e.g., coil 210) can be configured as the condenser coil. Alternatively, when the system 200 is in a heating cycle mode, the indoor heat exchange coil (e.g., coil 210) can be configured as the condenser coil and the outdoor heat exchanger (e.g., coil 205) be configures as the evaporator coil.

Such a system 200 could further include additional transfer lines and a reversing valve needed to facilitate such dual functionality. For the example system 200 illustrated in FIG. 2B further includes a reversing valve 230 having an input port 232, output port 234 and first and second reversing ports 236, 238, which are all in fluid communication with each other, e.g., depending on the actuation state of the valve 230. For the example system 200 the input port 232 is coupled to the discharge line 220, the output port 234 is coupled to the suction line 225. The first reversing port 236 is coupled to a first transfer line 240 connected to the first heat exchange coil 205, and, the second reversing port 238 is coupled to a second transfer line 245 connected the second heat exchange coil 210 (e.g., transfer lines made of copper tubing).

In some embodiments of the system 200 such as illustrated in FIG. 2B it is therefore desirable to have two distributor assemblies 100 250, each being coupled to one of the heat exchange coils 205, 210. For instance, as illustrated in FIG. 2B, the delivery tubes 144 of the distributor assembly 100 (e.g., a first distributor assembly) are each fluidly connected to different access ports 150 of the first heat-exchange coil 205 (e.g., the outdoor coil). The delivery tubes 144 of the second distributor assembly 250 are each fluidly connected to different access ports 150 of the second heat-exchange coil 210 (e.g., the indoor coil). In such systems it is desirable for the sealed expansion device 105 to further include the check valve functionality as described above in the context or FIGS. 1A and 1B.

Alternatively, in other embodiments of the system 200, such as illustrated in FIG. 2C, still have a single distributor assembly 100 that includes the embodiment of the sealed expansion device 105 having two orifice housings 126 integrated therein and configured as discussed in the context of FIG. 1C. As illustrated in FIG. 2C, the assembly 100 can further include a second sealed distributor housing 110 that is sealed to the second opening 122 (FIG. 1C), e.g., to facilitate coupling to the second heat-exchange coil 210 via delivery tubes 144. In such systems the connection line 227 (FIG. 2A or 2B) is not needed. One set of delivery tubes 144 of the distributor assembly 100 are each fluidly connected to different access ports 150 of the first heat-exchange coil 205 (e.g., the outdoor coil), and a second set of delivery tubes 144 of the distributor assembly 100 are each fluidly connected to different access ports 150 of the second heat-exchange coil 210 (e.g., the indoor coil). Once again, in such systems it is desirable for the sealed expansion device 105 to further include the above-described check valve functionality.

When heat-pump embodiments of the system 200, such as illustrated in FIG. 2B or 2C, are put into a cooling cycle mode, the reversing valve 230 is actuated such that the refrigeration fluid is transferred via the input port 232, first reversing port 236 and first transfer line 240 to the outdoor coil (e.g., coil 205). When this system 200 is put into a heating cycle mode, the reversing valve 230 is actuated such that the refrigeration fluid is transferred via the input port 232, second reversing port 238 and second transfer line 245 to the indoor coil (e.g., coil 210).

One of ordinary skill would understand that any of the systems 200 discussed in the context of FIG. 2A-2C could include additional components to facilitate their operation. For example, the system 200 could further include an in-line strainer, mesh or filter for contaminates protection.

Figure 3:
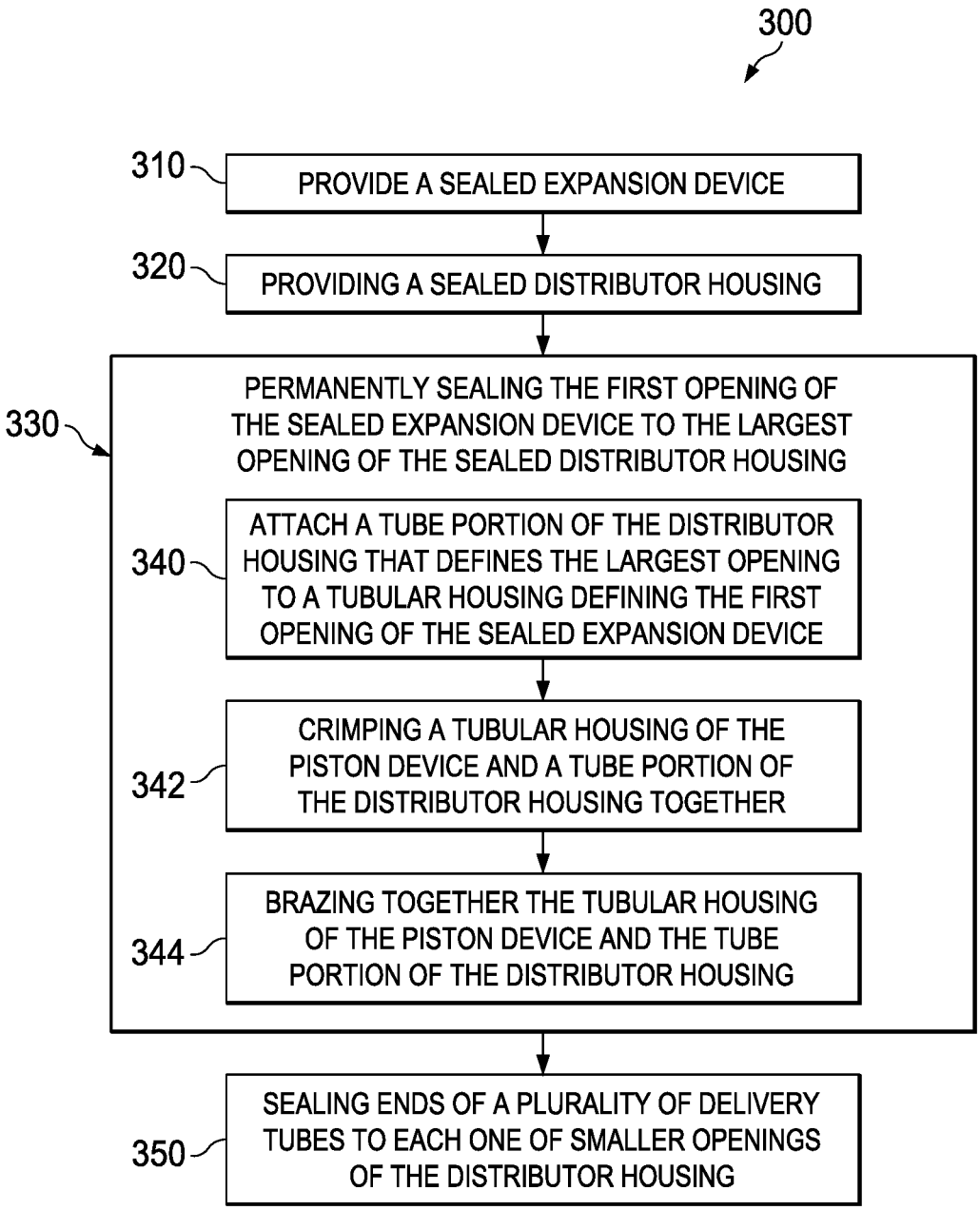
FIG. 3 presents a flow diagram of an example method of manufacturing a distributor assembly of the disclosure, such as the any of the embodiments of the distributor assembly discussed in the context of FIGS. 1A through 2B.

Still another embodiment of the disclosure is a method of manufacturing the distributor assembly. FIG. 3 presents a flow diagram of an example method of manufacturing a distributor assembly of the disclosure, such as the any of the embodiments of the distributor assembly 100 discussed in the context of FIGS. 1A through 2B.

With continuing reference to FIGS. 1A-2C, throughout, the method 300 comprises a step 310 of providing a sealed expansion device 105 having the first opening 120, the second opening 122 and the interior chamber 124 therebetween, with at least one orifice housing 126 therein. For instance, the expansion device 105 can include a brass piston-shaped orifice housing 126 inside of a tubular housing 165 (e.g., a copper tube) that is crimped down at or near its ends 170, 172 so that the orifice housing 126 is confined to move between the first opening 120 and the second opening 124 within the interior chamber 124. For instance, the orifice housing 126 can be sized and shaped to move between the first opening 120 and the second opening 122 within the interior chamber 124. For instance, the orifice housing 126 can be sized and shaped so that the outer surface 130 of the orifice housing forms a fluid stop around the first opening 120, such that the refrigeration fluid delivered through the second opening 122 can substantially only pass through the through-hole orifice 128 to the first opening 120. Based on the present disclosure one of ordinary skill would appreciate how to apply such procedures to an expansion device 105 that includes two orifice housings 126 such as illustrated in FIG. 1C, as part of step 310.

In some cases, embodiments of the expansion device 105 can be provided via a commercial source such as Danfoss (Baltimore Md.).

The method 300 further comprises a step 320 of providing a sealed distributor housing 110 having a largest opening 132 configured to be connected to the first opening 120 of the expansion device, and further including a plurality of smaller openings 136 configured to be fluidly connected to a heat-exchange coil 140. For instance, a brass work piece can be molded or machined to form distributor housing 110 with its openings 132, 136 on opposite ends 134, 138 of the housing, and the internal chamber 155 there-between.

In some cases, embodiments of the distributor housing 110 can be provided via a commercial source such as Parker Hannifin Corporation, Sporlan Division (Washington, Mo.).

The method 300 also comprises a step 330 of permanently sealing the first opening 120 of the sealed expansion device 105 to the largest opening 132 of the sealed distributor housing 110.

In some embodiments, the step 330 of permanently sealing, includes a step 340 of attaching (e.g., via inserting, in some case) a tube portion 142 of the distributor housing 110 that defines the largest opening 132 to (e.g., into, in some cases) a tubular housing 165 defining the first opening 120 of the sealed expansion device 105. In some embodiments, the step 330 of permanently sealing, includes a step 342 of crimping the tubular housing 165 of the piston device 105 and the tube portion 142 of the distributor housing 110 together. In some embodiments, the step 330 of permanently sealing, includes a step 344 of brazing together the tubular housing 165 of the piston device 105 and the tube portion 142 of the distributor housing 110. For the purposes of the present disclosure, the term, brazing, as used herein, refers to any form of soldering or welding metal work pieces to together, e.g., using conventional solder and flux, or other materials familiar to those skilled in the art.

Some embodiments of the method 300 further include a step 350 of sealing ends 146 of a plurality of delivery tubes 144 to each one of the smaller openings 136 of the distributor housing 110. For instance, the delivery tubes 144 can be copper tubes that are each brazed sealed to one the smaller openings 136, however other metals such as aluminum or metal alloys, familiar to those skilled in the art could be used.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A space conditioning system, comprising:

a first heat-exchange coil;

a second heat-exchange coil;

a compressor configured to compress a refrigeration fluid and to transfer the refrigeration fluid to a discharge line and to receive the refrigeration fluid from a suction line, wherein the discharge line is connected to one of the first heat-exchange coil or the second heat-exchange coil, and the suction line is connected to the other of the first heat-exchange coil or the second heat-exchange coil; and a distributor assembly, including:

a sealed expansion device having a first opening, a second opening and an interior chamber between the first opening and the second opening, the interior chamber containing an orifice housing comprising a first orifice-housing end and a second orifice-housing end, wherein the orifice housing has a through-hole orifice therein and the orifice housing is configured to move between the first opening and the second opening within the interior chamber, and, an outer surface of the first orifice-housing end forms a fluid stop around the first opening such that the refrigeration fluid delivered through the second opening can substantially only pass through the through-hole orifice to the first opening;

wherein the outer surface of the first orifice-housing end, wherein the longitudinal axis extends from the first to the first orifice-housing end to the second orifice-housing end and an outer surface of the second orifice-housing end have distinct shapes, wherein the outer surface of the first orifice-housing end comprises a spherically-shaped end and the outer surface of the second orifice-housing end comprises an inward taper extending away from the first orifice-housing end, wherein the inward taper has a length along a longitudinal axis of the orifice-housing which is longer than half an entire length of the orifice housing thereby forming a frustoconical end opposite the first orifice-housing end, wherein the longitudinal axis extends from the first to the first orifice-housing end to the second orifice-housing end;

a sealed distributor housing having a first opening at a first end of the sealed distributor housing, wherein the first opening of the sealed distributor housing is permanently sealed to the first opening of the sealed expansion device and further includes a plurality of secondary openings at a second end of the sealed distributor housing and configured to be fluidly connected to one of the first heat-exchange coil or the second heat-exchange coil;

an internal chamber between the first end of the sealed distributor housing and the second end of the sealed distributor housing, wherein the internal chamber narrows to a smallest dimension of the internal chamber before increasing again towards the second end of the sealed distributor housing; and a plurality of delivery tubes, wherein one end of each of the plurality of delivery tubes is sealed to one of the plurality of secondary openings at the second end of the sealed distributor housing, and, another end of each of the plurality of delivery tubes are each fluidly connected to different access ports of the one first heat-exchange coil or second heat-exchange coil.

2. The system of claim 1, wherein the first heat-exchange coil is configured as an evaporator coil of the space conditioning system configured as an air-conditioning system, the plurality of delivery tubes are each fluidly connected to the different access ports of first heat-exchange coil, and, the first opening of the sealed expansion device is configured to receive the refrigeration fluid transferred though the discharge line.

3. The system of claim 2, wherein the second heat-exchange coil is configured as a condenser coil, and to receive the refrigeration fluid from the first heat exchange coil and transfer the refrigeration fluid to the suction line.

4. The system of claim 2, wherein the first heat-exchange coil is configured as an outdoor coil, and the second heat-exchange coil is configured as an indoor coil, of the space conditioning system configured as a heat-pump system.

5. The system of claim 4, further including a reversing valve having an input port, output port and first and second reversing ports, wherein:

the input port, the output port and the first and second reversing ports are all in fluid communication, the input port is coupled to the discharge line, the output port is coupled to the suction line, the first reversing port is coupled to the first heat exchange coil, and the second reversing port is coupled to a transfer line connected the second heat-exchange coil.

6. The system of claim 4, wherein the plurality of delivery tubes of the distributor assembly are each fluidly connected to different access ports of the first heat-exchange coil.

7. The system of claim 4, further including a second one of the distributor assembly, wherein the plurality of delivery tubes of the second distributor assembly are each fluidly connected to different access ports of the second heat-exchange coil.

8. A method of manufacturing a distributor assembly for a space conditioning system, comprising:

providing a sealed expansion device having a first opening, a second opening and an interior chamber between the first opening and the second opening, the interior chamber containing at least one orifice housing comprising a first orifice-housing end and a second orifice-housing end, wherein the orifice housing has a through-hole orifice therein and the orifice housing is configured to move between the first opening and the second opening within the interior chamber, and, an outer surface of the first orifice-housing end of the orifice housing forms a fluid stop around the first opening such that a refrigeration fluid of the space conditioning system delivered through the second opening can substantially only pass through the through-hole orifice to the first opening;

wherein the outer surface of the first orifice-housing end and an outer surface of the second orifice-housing end have distinct shapes, wherein the outer surface of the first end of the orifice housing comprises a spherically-shaped end and the outer surface of the second end of the orifice housing comprises an inward taper extending away from the first orifice-housing end, wherein the inward taper has a length along a longitudinal axis of the orifice-housing which is longer than half an entire length of the orifice housing thereby forming a frusto-conical end opposite the first orifice-housing end;

providing a sealed distributor housing having a first opening at a first end of the sealed distributor housing, wherein the first opening of the sealed distributor housing is configured to be connected to the first opening of the expansion device, and further including a plurality of secondary openings at a second end of the sealed distributor housing and configured to be fluidly connected to a heat-exchange coil of the space conditioning system, and wherein an internal chamber is between the first end of the sealed distributor housing and the second end of the sealed distributor housing, the internal chamber narrowing to a smallest dimension of the internal chamber before increasing again towards the second end of the sealed distributor housing; and permanently sealing the first opening of the sealed expansion device to the first opening of the sealed distributor housing.

9. The method of claim 8, wherein permanently sealing the first opening of the sealed expansion device to the first opening of the sealed distributor housing includes:

attaching a tube portion of the distributor housing defining the first opening to a tubular housing defining the first opening of the sealed expansion device;

crimping the tubular housing of a piston device and the tube portion of the distributor housing together; and brazing together the tubular housing of the piston device and the tube portion of the distributor housing.

10. The method of claim 8, further includes sealing ends of the plurality of delivery tubes to each one of the plurality of secondary openings of the distributor housing.

11. The system of claim 1, wherein the first opening of the sealed distributor housing is larger than the plurality of secondary openings of the sealed distributor housing.

12. The method of claim 8, wherein the first opening of the sealed distributor housing is larger than the plurality of secondary openings of the sealed distributor housing.

* * * * *